US008590229B2

(12) United States Patent
Taylor et al.

(10) Patent No.: US 8,590,229 B2
(45) Date of Patent: Nov. 26, 2013

(54) INFLATABLE ATTIC STAIRWAY INSULATION APPLIANCE

(75) Inventors: Curtis P. Taylor, Moreland Hills, OH (US); Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 124 days.

(21) Appl. No.: 13/232,024

(22) Filed: Sep. 14, 2011

(65) Prior Publication Data

US 2012/0060427 A1 Mar. 15, 2012

Related U.S. Application Data

(60) Provisional application No. 61/383,049, filed on Sep. 15, 2010.

(51) Int. Cl.

| | |
|---|---|
| ***E04G 11/04*** | (2006.01) |
| ***E04B 1/34*** | (2006.01) |
| ***E04H 15/20*** | (2006.01) |
| ***E02D 29/14*** | (2006.01) |
| ***E06B 1/04*** | (2006.01) |
| ***E06C 7/00*** | (2006.01) |

(52) U.S. Cl.
USPC ..... 52/205; 52/19; 52/2.14; 52/2.22; 52/2.25; 182/46

(58) Field of Classification Search
USPC ..... 52/19, 79.7, 107, 20, 205, 186, 52/2.1–2.14, 2.17–2.19, 2.22–2.26; 49/9, 49/399, 402; 182/46, 47, 77
See application file for complete search history.

(56) References Cited

U.S. PATENT DOCUMENTS

| | | | | |
|---|---|---|---|---|
| 2,321,499 | A | 6/1943 | Marschke | |
| 3,619,340 | A | 11/1971 | Jones | |
| 3,807,528 | A | 4/1974 | Frank | |
| 4,040,210 | A * | 8/1977 | Land | 52/2.12 |
| 4,151,894 | A * | 5/1979 | Edwards | 182/77 |
| 4,281,743 | A | 8/1981 | Fuller | |
| 4,299,059 | A | 11/1981 | Smith | |
| 4,312,423 | A * | 1/1982 | Helbig | 182/46 |
| 4,337,602 | A * | 7/1982 | King | 52/202 |
| 4,344,505 | A | 8/1982 | Waters | |
| 4,541,208 | A | 9/1985 | Vesperman | |

(Continued)

FOREIGN PATENT DOCUMENTS

| | | |
|---|---|---|
| CA | 2080680 A1 | 10/1993 |
| EP | 2108761 A2 | 10/2009 |

OTHER PUBLICATIONS

Internet Website, "The Battic © Door Attic Stairs Insulator Cover", http://www.batticdoor.com/StairCoverHow.htm; printed Jul. 25, 2011, 2 pgs.

(Continued)

*Primary Examiner* — Ryan Kwiecinski
(74) *Attorney, Agent, or Firm* — Fay Sharpe LLP

(57) ABSTRACT

An inflatable insulator covers an associated attic access hatch to prevent a transfer of heat from a first indoor environment maintaining temperature control and a second indoor environment not maintaining temperature control. The insulator includes at least one air chamber adapted to contain a volume of stationary air. Impermeable layers define the air chamber. Sidewalls extending from a generally planar top wall to remove the impermeable layers from a direct contact with the access hatch.

18 Claims, 14 Drawing Sheets

(56) References Cited

U.S. PATENT DOCUMENTS

| | | | | | |
|---|---|---|---|---|---|
| 4,541,508 | A | * | 9/1985 | Lundh | 182/78 |
| 4,550,534 | A | * | 11/1985 | Mariano et al. | 52/19 |
| 4,563,845 | A | | 1/1986 | Stipe | |
| 4,591,022 | A | | 5/1986 | Sciambi | |
| 4,658,555 | A | * | 4/1987 | Steiner | 52/202 |
| 4,712,343 | A | | 12/1987 | Dearing | |
| 4,832,153 | A | * | 5/1989 | Daw et al. | 182/46 |
| 4,928,441 | A | | 5/1990 | Daley | |
| 5,220,757 | A | | 6/1993 | Hulligan | |
| 5,271,198 | A | | 12/1993 | Freeman | |
| 5,274,966 | A | | 1/1994 | Daley | |
| 5,475,955 | A | * | 12/1995 | Dickinson | 52/202 |
| 5,481,833 | A | | 1/1996 | Williams | |
| 5,623,795 | A | * | 4/1997 | Padgett, Jr. | 52/202 |
| 5,628,151 | A | * | 5/1997 | Monat | 52/19 |
| 5,867,946 | A | * | 2/1999 | Seagren | 52/19 |
| 5,953,866 | A | | 9/1999 | Poole | |
| 6,014,841 | A | * | 1/2000 | McCoy et al. | 52/19 |
| RE36,975 | E | * | 12/2000 | Williams | 52/19 |
| 6,223,490 | B1 | | 5/2001 | Wessley | |
| 6,357,185 | B1 | | 3/2002 | Obermeyer et al. | |
| 6,601,352 | B1 | * | 8/2003 | Obermeyer et al. | 52/202 |
| 6,625,933 | B1 | | 9/2003 | Moeller | |
| 6,701,676 | B1 | | 3/2004 | Kompelien | |
| 6,848,492 | B2 | * | 2/2005 | Thomas | 160/368.1 |
| 6,863,949 | B2 | | 3/2005 | Ehrmanntraut | |
| 6,966,153 | B2 | | 11/2005 | Panetta et al. | |
| 7,089,704 | B2 | | 8/2006 | Jejina et al. | |
| 7,434,363 | B2 | | 10/2008 | Panetta et al. | |
| D586,473 | S | * | 2/2009 | Copeland | D25/48.3 |
| 7,650,722 | B1 | | 1/2010 | Melesky | |
| 7,690,165 | B2 | * | 4/2010 | Taylor | 52/406.1 |
| 7,770,353 | B2 | | 8/2010 | Olsen | |
| 7,849,644 | B2 | | 12/2010 | Melesky | |
| D632,804 | S | | 2/2011 | Afasano | |
| 7,926,229 | B2 | * | 4/2011 | Melesky | 52/205 |
| 2002/0112409 | A1 | | 8/2002 | Knowles | |
| 2004/0055819 | A1 | | 3/2004 | Lynn et al. | |
| 2004/0172893 | A1 | | 9/2004 | Hunter | |
| 2009/0061147 | A1 | * | 3/2009 | Lippy et al. | 428/76 |
| 2009/0071682 | A1 | | 3/2009 | Crawford, Jr. | |
| 2009/0094908 | A1 | * | 4/2009 | Krueger et al. | 52/202 |
| 2009/0255757 | A1 | | 10/2009 | Burke | |
| 2011/0225899 | A1 | * | 9/2011 | Melesky | 52/19 |

OTHER PUBLICATIONS

Internet Website, Attic Tent, Product No. TNT101, http://www.skymall.com/shopping/detail.htm?pid=69764487&c=10....; printed Jul. 25, 2011, 3 pgs.

Internet Website, Attic Tent®, http://www.attictent.com/purchase.htm, printed Jul. 25, 2011, 2pgs.

Magazine Advertisement, Attic Tent™, Product No. TNT101G; *Sky Mall,* p. 133.

* cited by examiner

INFLATABLE ATTIC STAIRWAY INSULATION APPLIANCE

This application claims the benefit of priority to U.S. Provisional Patent Application No. 61/383,049, filed Sep. 15, 2010, entitled "INFLATABLE ATTIC STAIRWAY INSULATION APPLIANCE", by Curtis P. Taylor, the disclosure of which is hereby incorporated by reference in its entirety.

BACKGROUND

The present disclosure is related to an inflatable insulator for covering an attic access hatch and, more specifically, to an insulator including at least two impermeable layers defining a chamber adapted to contain a volume of stationary air.

Many structures may include an attic or bonus space, which typically functions as a storage space because of an uneasy access, reduced ceiling height, or other reasons. Accordingly, construction of the attic space does not ordinarily follow the same building standards as that for the living space. More specifically, ventilation and insulation techniques utilized for the living spaces and the attic spaces are distinct. Most attics are not sufficiently insulated to form living space, so temperatures can reach excesses that significantly deviate from the controlled temperature in the living space of the structure.

Ventilation is also different in attics. Model building codes require attic spaces to be ventilated. A ventilated attic receives an air current pulled from an exterior of the structure. This air current is typically pulled in proximity to a lower surface of the attic space. The air current is pulled upwardly toward the most elevated region of the attic, where it is returned to the exterior environment.

During cooler seasons when the temperature is controlled to heat the living and/or work spaces of a structure, warm air rises because it has a lower density than cooler air. Because attic access hatches are generally not formed with seals (due to no significant risk of water leakage), this warm air can seep through the space formed between the access hatch and its frame. The ventilation air stream carries this warm air outside the structure. Even in structures not utilizing a ventilation system, heat in the structure may be lost through the access hatch to the colder environment in the non-heated attic space because heat transfers from a warmer body to a cooler body. Additionally, heat is conducted through the access hatch, thus causing the functional space of the structure to lose heat to the attic in winter and air-conditioning effort in the summer.

In warmer conditions, extremely hot temperatures in the attic space may also draw more power from an air conditioner unit maintaining cooler temperatures in the living spaces. Regardless of the season, utility costs may be unnecessarily driven to higher amounts based on inadequate insulation at the access hatch. Inadequate insulation may cause the furnace and air conditioner appliances to consume more energy in an effort to compensate for temperature losses and/or gains at the attic access hatch. A low-cost and easily positioned insulator unit is needed at the access hatch for effectively preventing heat convection.

BRIEF DESCRIPTION

A first exemplary embodiment of the present disclosure is directed toward an insulator for insulating an attic access hatch. The insulator includes an inflatable body having a polygonal and a generally planar top wall. Sidewalls extend from edges of the top wall. The sidewalls remove the top wall from a direct contact with the attic access hatch. The insulator further includes an air chamber adapted to contain a volume of stationary air. The air chamber insulates the access hatch from transferring heat between a non-temperature controlled space and a temperature controlled space.

A second exemplary embodiment of the present disclosure is directed toward an insulator for preventing a transfer of heat from a first indoor environment maintaining temperature control and a second indoor environment not maintaining the temperature control. The insulator includes a first impermeable layer spaced apart from a second impermeable layer. A chamber between the first and the second layers is adapted to contain a volume of stationary air. The first impermeable layer completely surrounds an opening for providing an access to the second indoor environment to prevent movement of air from traveling generally beyond the opening and into the second indoor environment.

A third exemplary embodiment of the present disclosure is directed toward an inflatable insulator for covering an attic access hatch. The inflatable insulator includes at least one air chamber adapted to contain a volume of stationary air. At least two impermeable layers define the air chamber. The at least two impermeable layers are removed from contact with the access hatch.

DETAILED DESCRIPTION

The present disclosure is related to an inflatable insulator for an attic access hatch. The embodiments herein are more specifically described for ceiling attic access hatches; however, the features described herein may be similarly utilized or modified for use with side-entry attic access hatches. The inflatable insulator aims to insulate the access hatch from transferring heat between a non-temperature controlled space and a temperature controlled space. Accordingly, it is anticipated that the features and construction described herein may find equal application for insulating (single or multiple, sectional) panels and doors situated in other structures, such as, for example, garages, temporary storage units, closet spaces, and underground cellars, etc.

Figure 1:
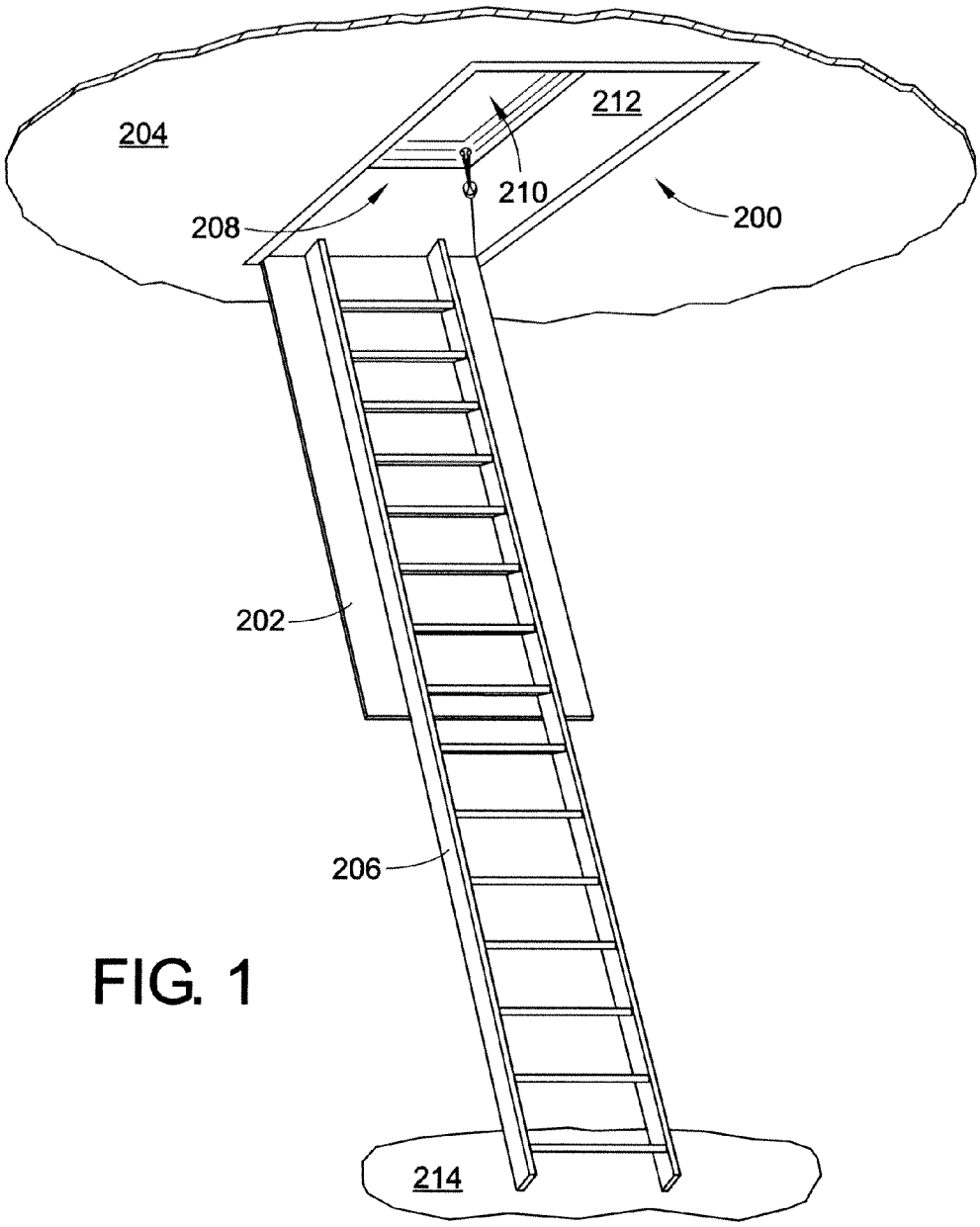
FIG. 1 illustrates a perspective view of an attic access hatch observed from a living or work space.

FIG. 1 illustrates an exemplary ceiling access hatch 200 (herein synonymously referred to as an "attic access hatch" and "access hatch"). Most attics are made accessible by passage through the access hatch 200, which includes a door or a panel 202 hingedly connected to a wall or ceiling 204 that is shared between the attic space and an indoor living or work space. This access hatch 200 typically pivots downwardly toward a person accessing the attic from the living space. A rope (not shown) may be connected to the panel 202 to assist in pulling it downwardly. In many instances, a collapsible fold-/pull down ladder 206 attached to the panel 202 is stored in a recess 208 in a panel opening 210. The ladder 206 includes a spring-loaded mechanism (herein referred to as a "power arm 216") to collapse it backwardly behind the panel 202. The ladder 206 is at least partially stored in the recess 208 region defined by a frame 212 during periods of non-use. The panel 202 is typically flush with the ceiling 204 of the living space. The frame 212 may include a depth dimension generally equivalent to a width of the ceiling joists or wall studs defining the ceiling wall. In this instance, the frame 212 does not protrude beyond a floor surface 214 of the attic space (see FIG. 1). The frame 212 may alternately include a depth dimension that extends beyond the floor surface 214. Embodiments are later discussed herein for both frame types.

Figure 2:
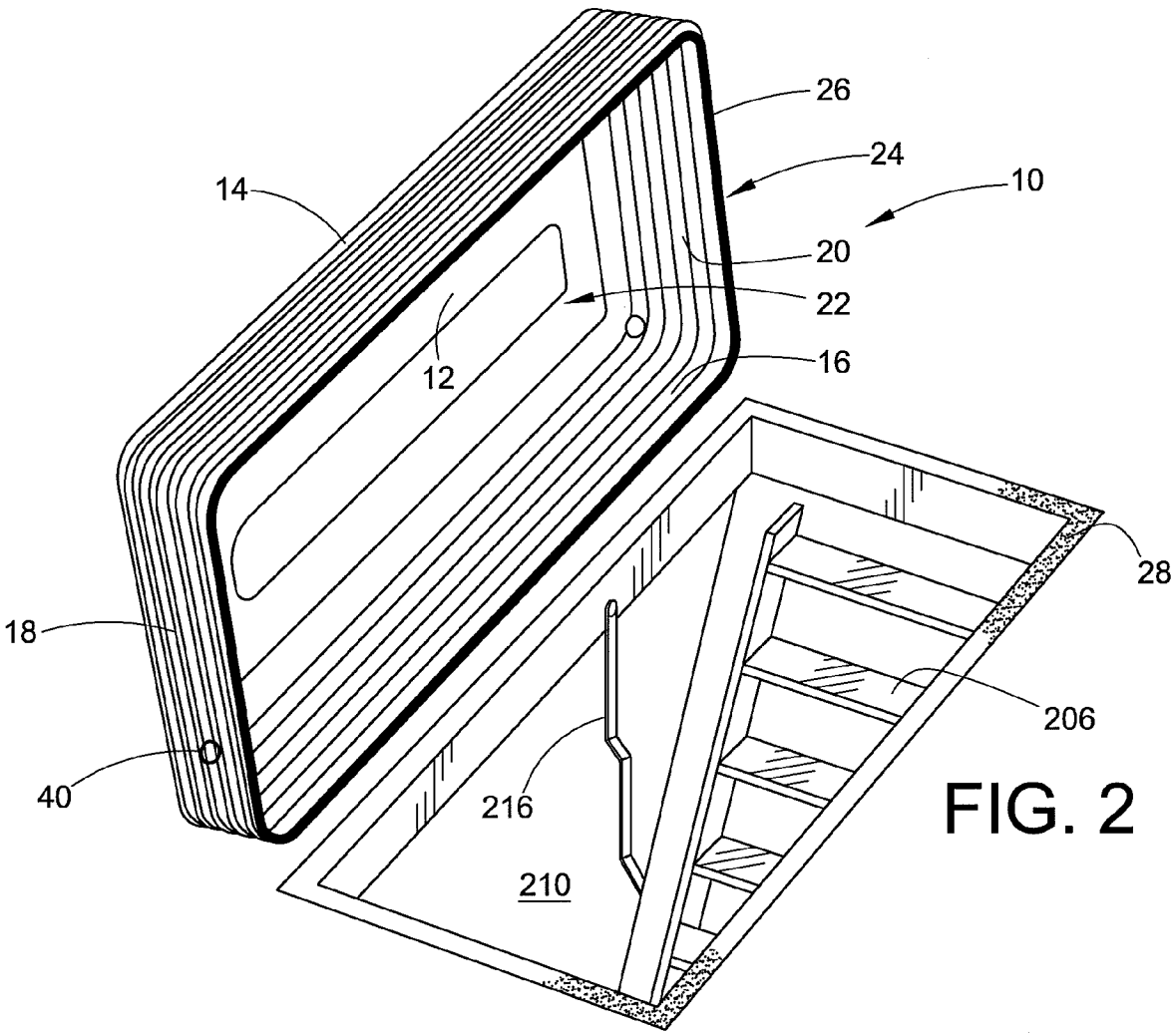
FIG. 2 illustrates a perspective view of the attic hatch of FIG. 1 observed from an attic space.
Figure 3:
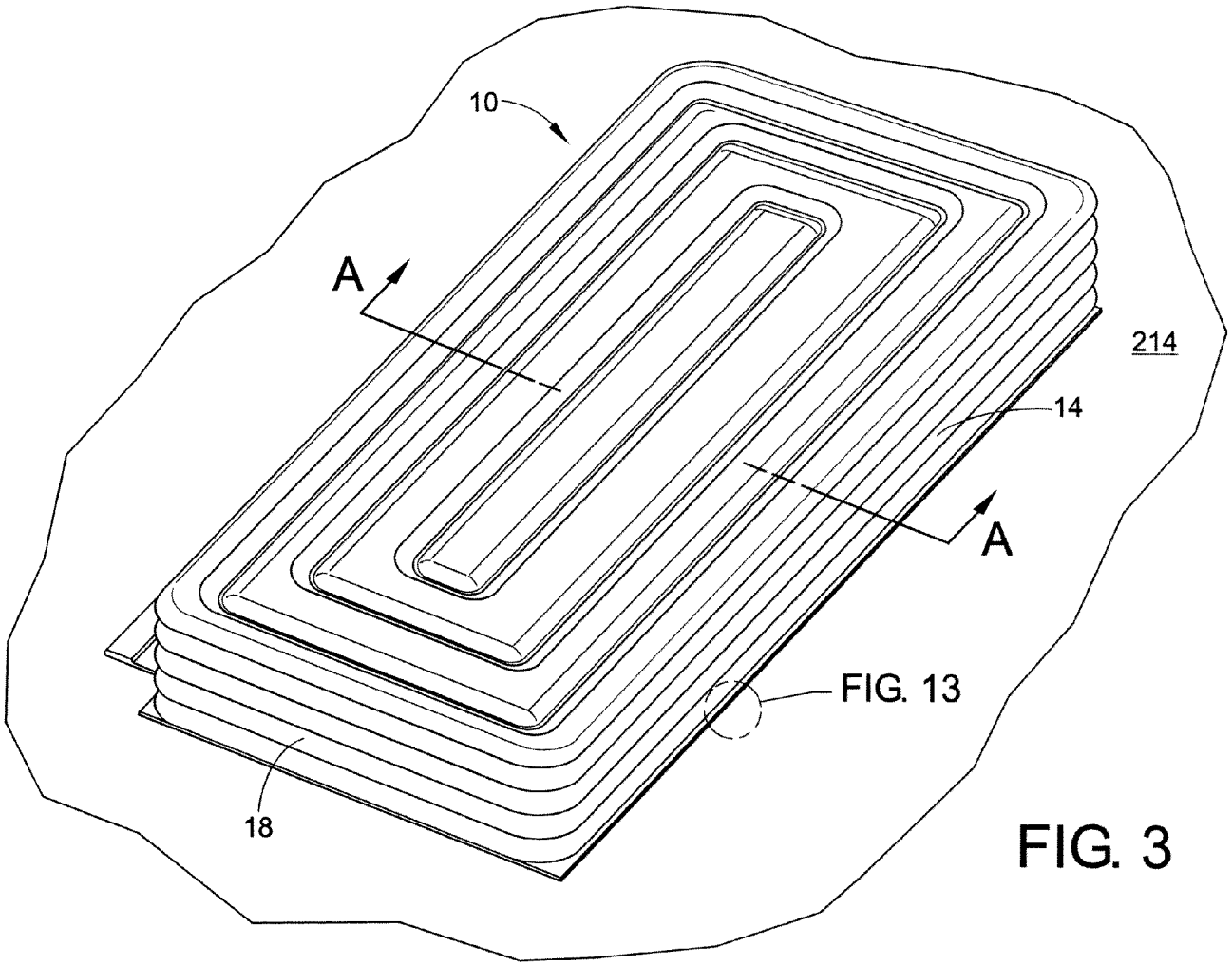
FIG. 3 illustrates a perspective view of a first embodiment of an inflatable insulator according to the present disclosure, wherein the insulator is in an operative position.

FIG. 2 illustrates a perspective view of the access hatch 200 observed from the attic space. FIG. 2 furthermore illustrates an inflatable insulator 10. FIG. 3 illustrates a perspective view of the insulator 10 covering and, henceforth, insulating the access hatch 200. The insulator 10 includes a first wall 12, which is more specifically a generally planar surface. In the exemplary embodiment, the first wall 12 rectangular and similar in shape to, but slightly larger than, the opening 210 of the access hatch 200. However, it may be in the shape of any polygon or oval or circular so long as it covers the access hatch opening 210. The first wall 12 shown in the figures is a quadrilateral having four sides. In one embodiment, the quadrilateral can be at least approximately 57 inches in length and at least approximately 27.5 inches in width. The first wall 12 is a top surface of a cabinet-like structure. Accordingly, sidewalls 14, 16, 18, 20 extend outwardly from the four sides defining the first wall 12 such that they extend downwardly from the first wall 12 when the inflatable insulator 10 is in operational position. These sidewalls 14-20 are situated generally perpendicular to the top wall 12; however, the sidewall can be slanted outwardly or otherwise. No limitation is made herein to an orientation of the sidewalls. The sidewalls 14-20 can measure approximately at least 6.7 inches in height. The sidewalls 14-20 and the top wall 12 define a cavity 22 adapted to receive portions of the ladder 206 that extend beyond the recess 208 when the ladder 206 is collapsed.

Figure 4:
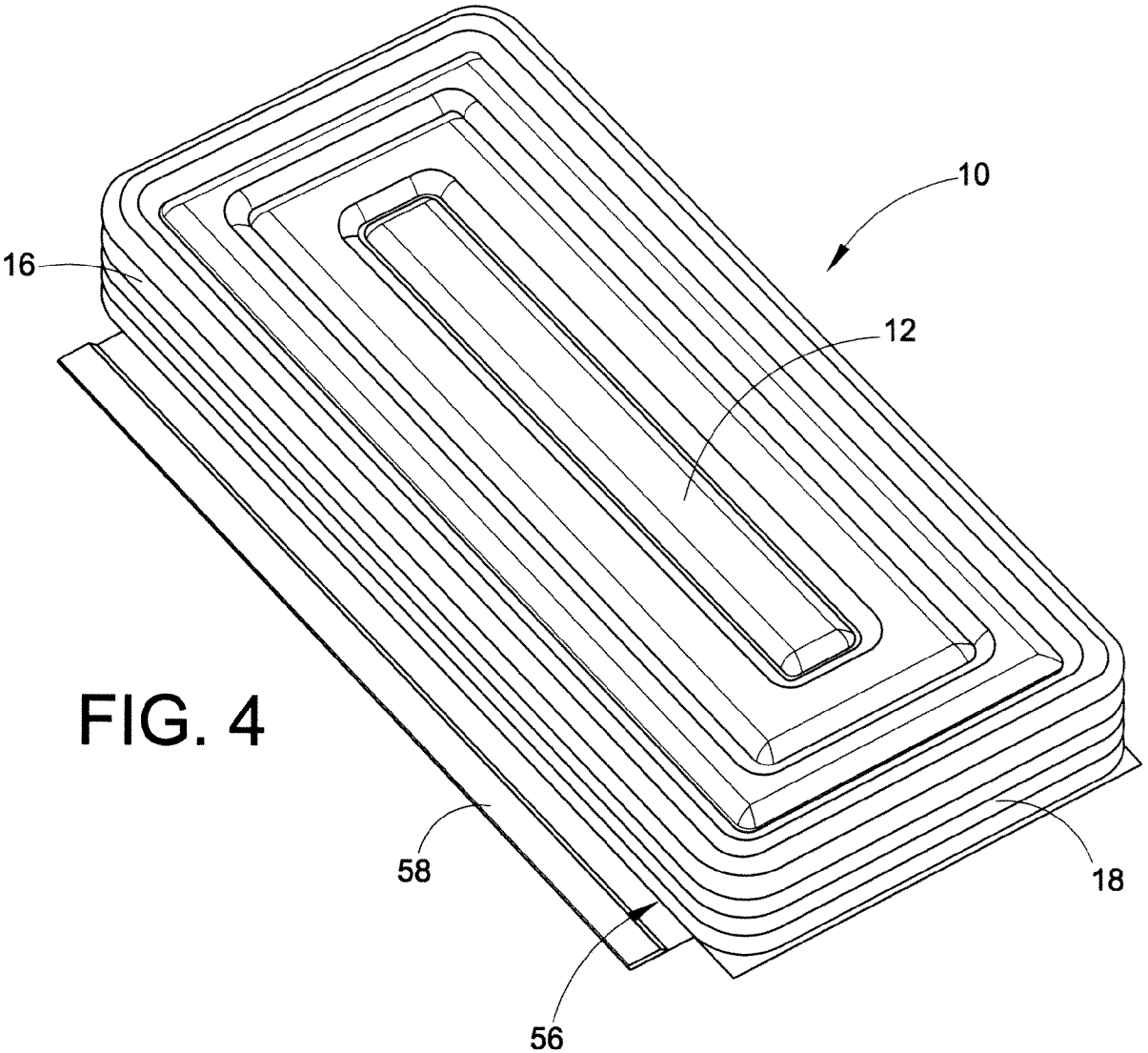
FIG. 4 illustrates a perspective view of the insulator.

When the present insulator is in an operative position, as shown in FIGS. 3 and 4, the first wall 12 is situated generally parallel to the floor surface 214 and the sidewalls 14-20 extend downwardly to stand vertically from the floor surface 214. The sidewalls 14-20 support the first wall 12 above the opening 210. One aspect of the area of the first wall 12 being slightly larger than the opening 210 is that a perimeter 24 defined by (lower) edges of the sidewalls 14-20 contact the floor surface 214 beyond a perimeter of the opening 210.

FIG. 2 illustrates a seal 26 deployed along an entire longitudinal extent of the perimeter 24 of the sidewalls 14-20. In one embodiment, the seal 26 is weather resistant. The seal 26 is adapted to prevent any leakage of air current and, hence, heat between the cavity 22 and the attic space. The seal 26 also protects the sidewalls 14-20 from wear. In one embodiment, a foam base 28 may attach to the floor surface 214. This foam base 28 outlines the perimeter of the opening 210. This foam base 28 may removeably affix to the floor by means of a tape or similar functioning adhesive. In one embodiment, the foam base may include at least one strip having a peel away cover that exposes an adhesive adapted to attach the strip to the floor surface 214. The strip(s) may correspond to the dimensions of a typical access hatch 200 such that it may be attached around the perimeter of the opening 210. In another embodiment, the dimensions of multiple strips may combine to form an outline of the perimeter 24 of the insulator 10 when they affix to the floor surface 214. In the preferred embodiment, the perimeter of the opening 210 matches the perimeter 24 of the insulator 10.

One aspect of the present insulator 10 is that the first wall 12 and the sidewalls 14-20 are removed from any direct contact with the access hatch 200 except for the seal 26 at the perimeter 24. The sidewalls 14-20 essentially support the first wall 12 above the access hatch 200. More specifically, the sidewalls 14-20 support the top wall 12 at a height above any exposed frame 212 or ladder 206 portions situated beyond the floor surface 214. The insulator 10 is removed from contact with the access hatch 200 so that heat cannot transfer from one body (i.e., the access hatch) to a second body through the insulator material. The insulator 10 is removed from direct contact with any physical or tangible body, including, for example, the frame 212 or the ladder 206, except at the perimeter. This also protects the insulation 10 from puncture or spot wear from contact with elements of the power arm 216 or ladder 206.

The first wall 12 and the sidewalls 14-20 of the insulator 10 include at least a first layer 30 formed from an impermeable material. The material is impermeable to moisture and air. The first wall 12 and the sidewalls 14-20 further include at least a second layer 32. This second layer 32 may also be formed of an impermeable material. It is anticipated that the first and second layers 30, 32 are formed of the same material. Exemplary impermeable materials may include a PVC vinyl plastic, a textile reinforced plastic, a vulcanized rubber, a polyurethane, or a combination of the above. It is anticipated that additional material layers may be incorporated in embodiments of the insulator.

The first and second layers 30, 32 are connected in proximity to the seal 26. In one embodiment, the first layer 30 and the second layer 32 are also spaced apart at portions to form an insulator 10 having a continuous body defining a closed space. The insulator 10 includes an air chamber 34 situated between the first and second layers 30, 32. The chamber 34 is adapted to contain a volume of relatively stationary air. One aspect of the present inflatable insulator 10 is an incorporation of the stationary air (layer). Stationary air is an effective insulator because it prevents moving air currents from transferring heat from warmer bodies to cooler bodies and/or environments. Another aspect of stationary air is that it is a poor conductor of heat. In one embodiment, it is contemplated that the air chamber 34 may further include at least two adjacent sub-chambers 36. Because air is an effective insulator, one aspect of the present disclosure is an inflatable insulator 10 including at least the volume of stationary air contained in the air chamber 34 or in multiple sub-chambers 36 surrounding the entire attic access hatch 200 in the attic space.

Figure 5:
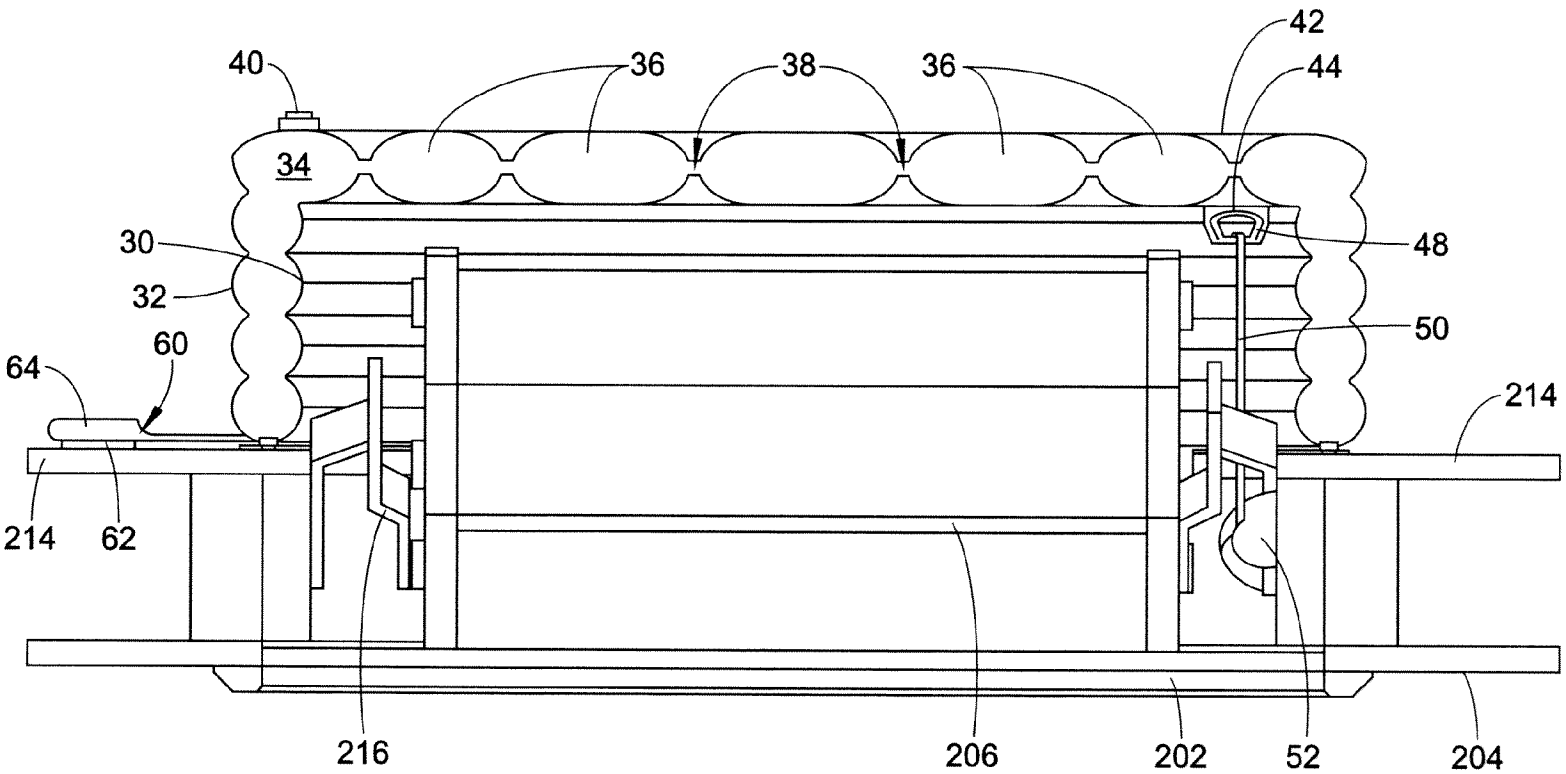
FIG. 5 illustrates a side cut-out view of the insulator taken along lines A-A of FIG. 3.
Figure 6:
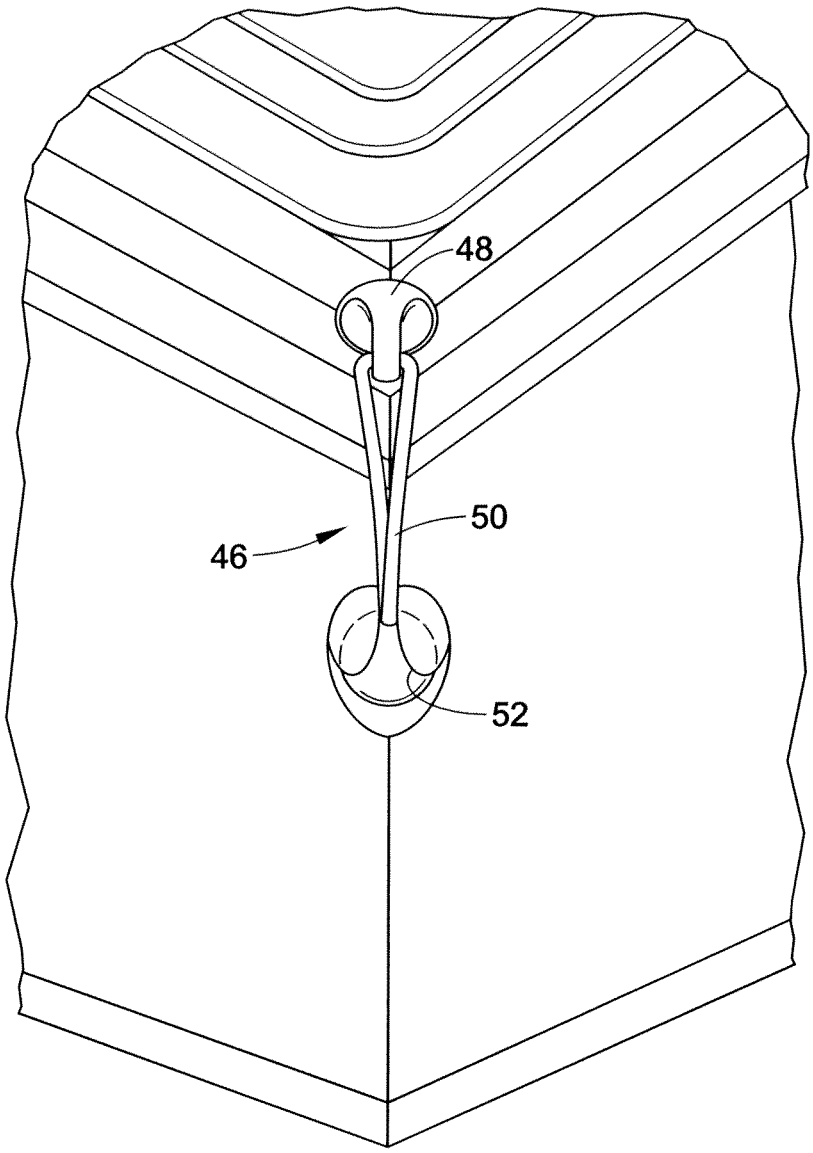
FIG. 6 illustrate a perspective view of an embodiment of a connection means for use in conjunction with the insulator.
Figure 7:
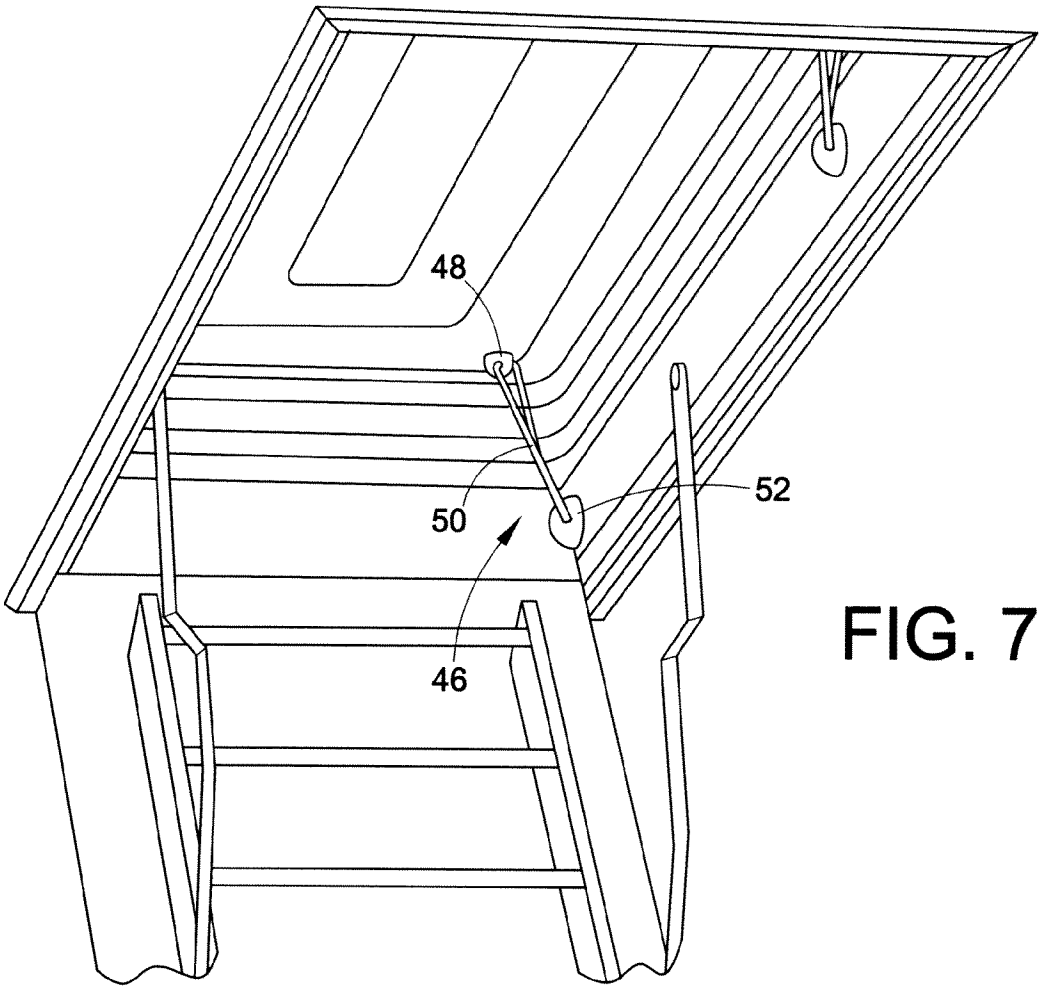
FIGS. 7 and 8 illustrate an underside perspective view of the connection means of FIG. 6 adapted to seal the insulator to the attic hatch.
Figure 8:
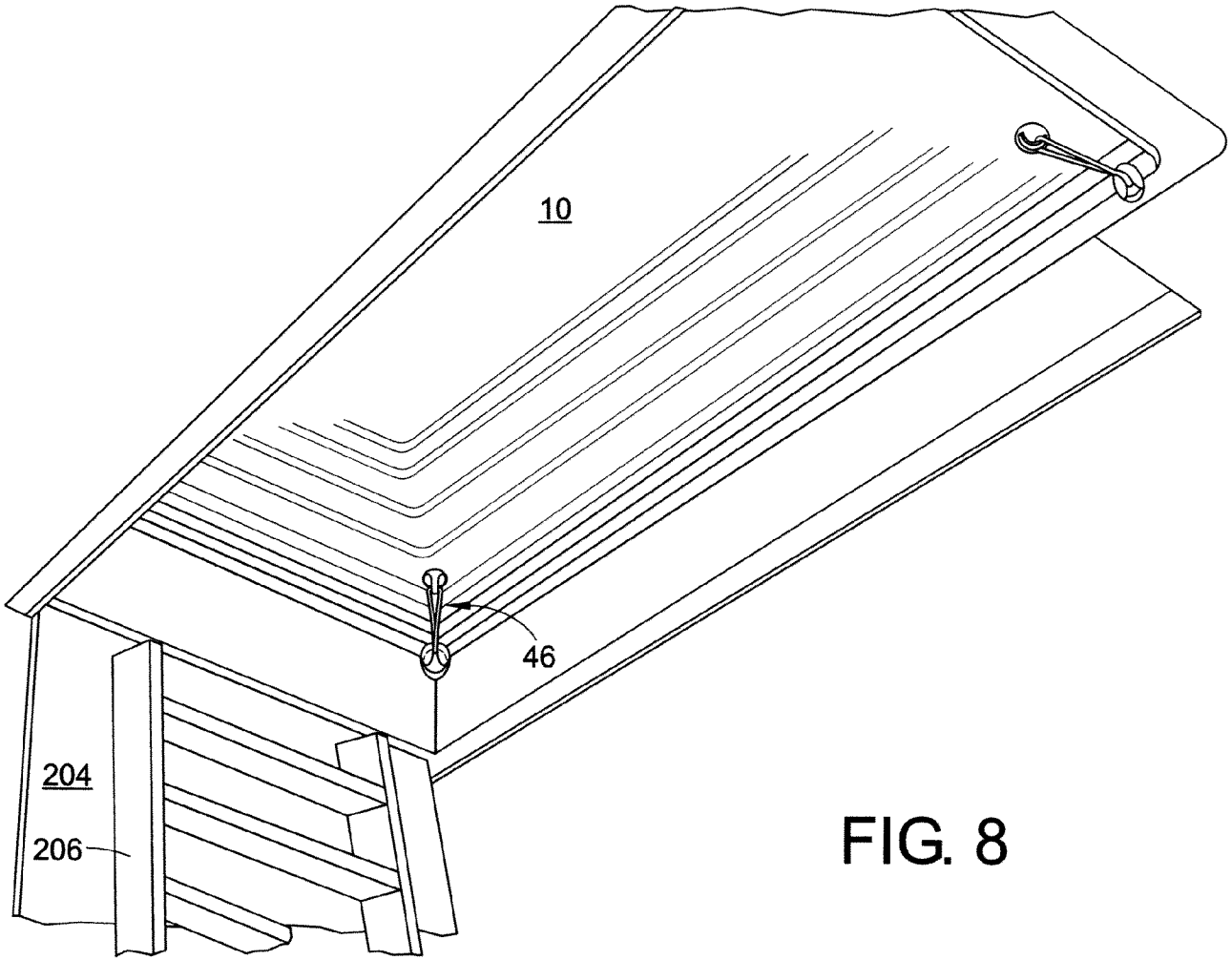

FIG. 5 illustrates a side cut-out view taken along lines A-A in FIG. 3. Multiple sub-chambers 36 are shown situated in connected relationship to one another. Each one sub-chamber 36 is either directly connected to adjacent sub-chambers 36 by an absence of a shared wall or by a small air-inflation channel 38. This air inflation channel 38 provides an air input path for air to travel from an input valve to each one sub-chamber. The sub-chamber may be separated from one another by means of welded, adhesive or other conventional attachments between the first and second layers 30, 32. The attachments of the layers 30, 32 may be continuous or intermittent lines.

The first and second layers 30, 32 are flexible so that the chamber 34 may adjust to variable volumes of air being placed into and displaced from the insulator 10. It is contemplated that the air chamber 34 or sub-chambers 36 expand when air is inflated into the insulator 10. A valve 40, an air port, or a similar functioning feature is situated in a user-accessible position on the insulator 10 and, more specifically, is oriented on a conspicuous surface of the outermost layer between the first and second layers 30, 32. In one embodiment, the valve 40 may include a one-way valve construction that receives an input of air to selectively inflate the insulator 10 while prohibiting an outbound egress of air, which would have an effect of unintentionally deflating the insulator 10. In one embodiment, the valve 40 can include a conventional two-way valve construction adapted to selectively inflate and deflate the inflatable insulator 10. The valve 40 is utilized for inflating the insulator 10. Any manual or automatic means for inflating the insulator body 10 in a deflated state (not shown) is contemplated herein without departing from a teaching and function of the present disclosure. In one embodiment, for example, it is contemplated that a pump mechanism (not shown) is provided in a kit with the disclosed insulator 10 to aid in altering it from a deflated to an inflated state.

FIG. 5 further illustrates an embodiment having at least one sub-chamber 36 situated between additional protective material layers. A third, outer layer 42 may cover at least a portion of an outer oriented surface of the outermost layer forming the first wall 12; however, the third layer 42 may cover the outer oriented surfaces of the entire second layer 32. A fourth, inner layer 44 may cover at least an outer oriented surface of the innermost layer forming the first wall 12. The fourth layer 44 may cover the outer oriented surfaces of the entire first layer 30.

It is anticipated that the fourth layer 44 may have at least a portion having some rigidity. One aspect of the rigidity is that it may protect the chamber 34 from potentially being punctured if the ladder 206 is urged into contact with it. Another aspect of the rigidity is that it provides a support surface for a connection means 46 to be affixed. Alternatively, in embodiments not including the fourth layer 44, the connection means 46 may be affixed to an outer oriented surface of the second layer 32.

The connection means 46 is adapted to provide for a manual attachment and detachment of the insulator 10 to a support structure. It is optional as the insulator's weight is enough to hold it in position in many installations. The connection means is illustrated in FIGS. 6-9 to include a first connector 48 connected by an elastic member 50 to a second connector 52. In a first embodiment, each of the first and second connectors 48, 52 are affixed to the insulator 10 and a support structure surface, respectively, while the elastic member 50 is stretched and manipulated to hook into the connectors 48, 52 when the insulator 10 is closed over the opening 210 of the access hatch 200. It is contemplated, for example, that at least one of the first and second connectors 48, 52 includes a hook 54 (see FIG. 9) adapted to receive an end of the elastic member 50. In another contemplated embodiment, the ends of the elastic member 50 are permanently thread through apertures in the first and second connectors 48, 52. In this embodiment, at least one of the first and second connectors 48, 52 is removeably attached to at least one of the insulator 10 or the support structure. It is contemplated that the removeably attachable connector is adapted to attach itself to the insulator 10 or the support structure by any known means including, for example, suction, adhesive, or a snap-fit arrangement with a corresponding piece, etc.

Figure 13:
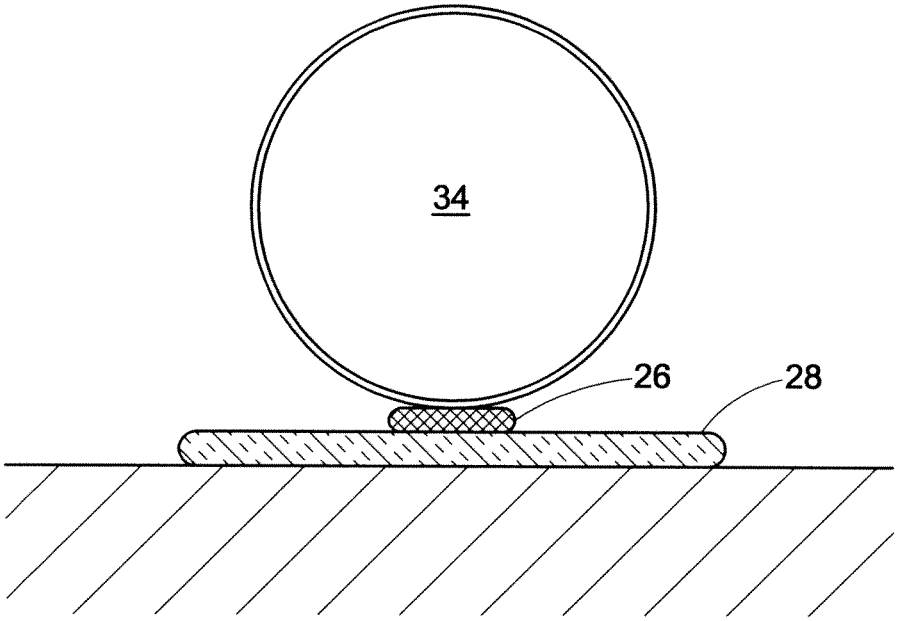
FIG. 13 illustrates a side detail view of a perimeter of the insulator.

The support structure that the second connector 52 is affixed to may include the floor surface 214 adjacent to the access hatch 200 or any fixed portion of the access hatch 200 (s.a., e.g., the frame 212). In the illustrated embodiments, the first connector 48 is affixed to an inner surface of the frame 212 or a (vertical) wall defining the perimeter of the opening 210 of the access hatch 200. It is contemplated, however, that the second connector 52 is affixed to or is removeably affixed to the support structure at a position that may not obstruct a path of movement of the power arms 216 of the ladder 206. The elastic member 50 is adapted to pull the insulator 10 toward the floor surface 214 so that a tight seal or suction is formed between the insulator 10 and the floor surface 214. The constant tension from the elastic member 50 sandwiches the weather seal 26 between the inflatable insulator 10 and the foam base 28, thus creating an airtight seal as shown in the detail view of FIG. 13. In this manner, a risk of air leakage and, hence, heat leakage is reduced. Embodiments are further contemplated that include multiple and alternate connection means 46. For instance, several straps may be fixed to the insulator at points around its periphery. The straps carry half of a hook-and-loop fastener on the ends away from the insulator 10. The other halves of the hook-and-loop fasteners are affixed, by adhesive or the like, around the perimeter of the opening 210. Accordingly, multiple connections means 46 are adapted to ensure an even seal around the entire perimeter 24.

To release the insulator 10 from this secure connection, a manual release of at least one of the first connector 48, the elastic member 50, or the second connector 52 is made. It is anticipated that a user may access the attic space from the living space. The user may open the panel 202 and pull the ladder 206 downwardly. The user may release the connection means 46 from an underside of the insulator 10, also identified herein as the cavity 22. Once the connection means is released, the insulator 10 is capable of being propped away from the opening 210 of the access hatch 200. In one embodiment, the insulator 10 may be propped away by a push upward on the insulator 10 from its underside.

Figure 10:
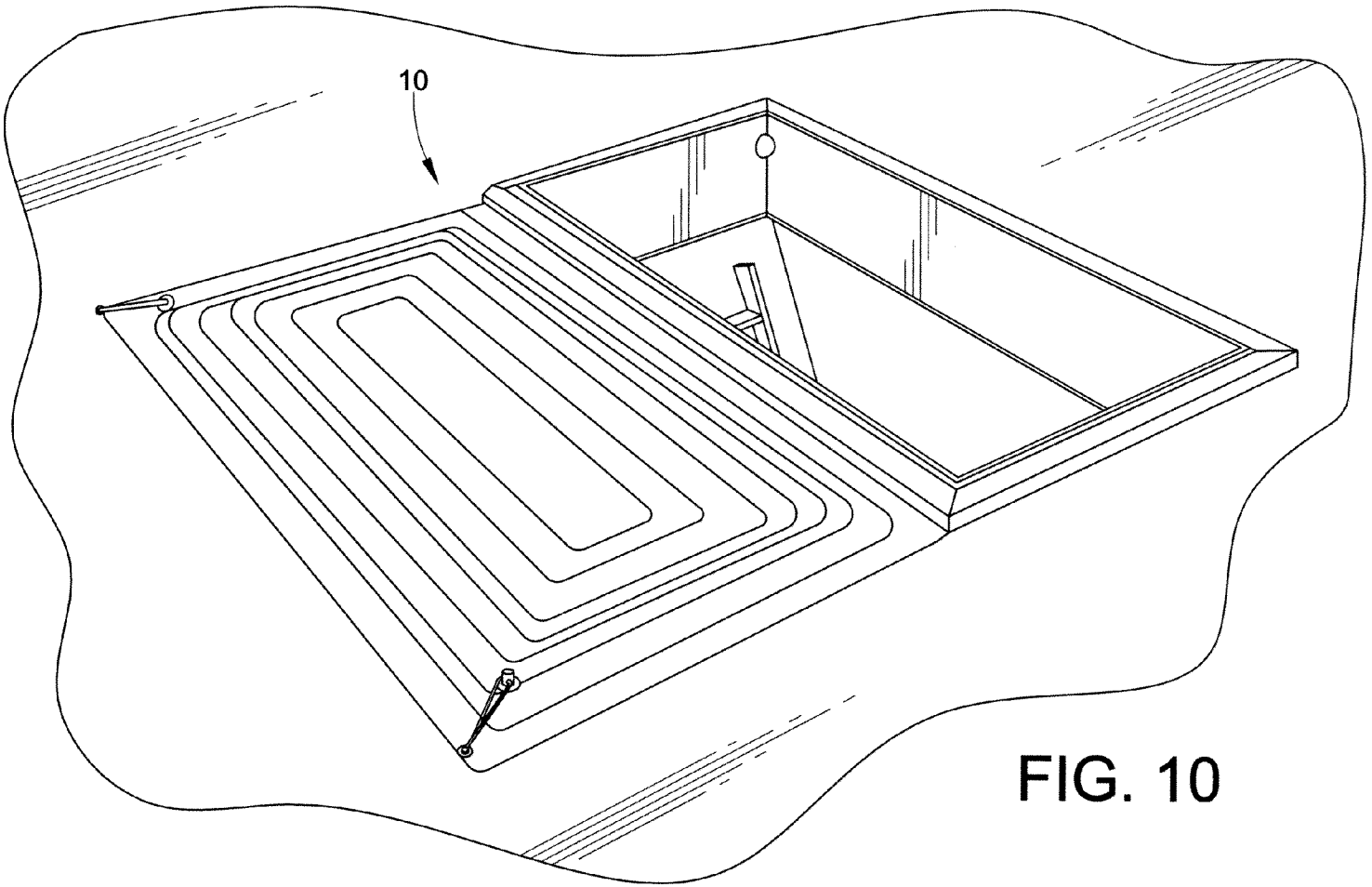
FIG. 10 illustrates a perspective view of the insulator according to another embodiment, wherein the insulator is adapted to pivot open in a non-operative position.
Figure 11:
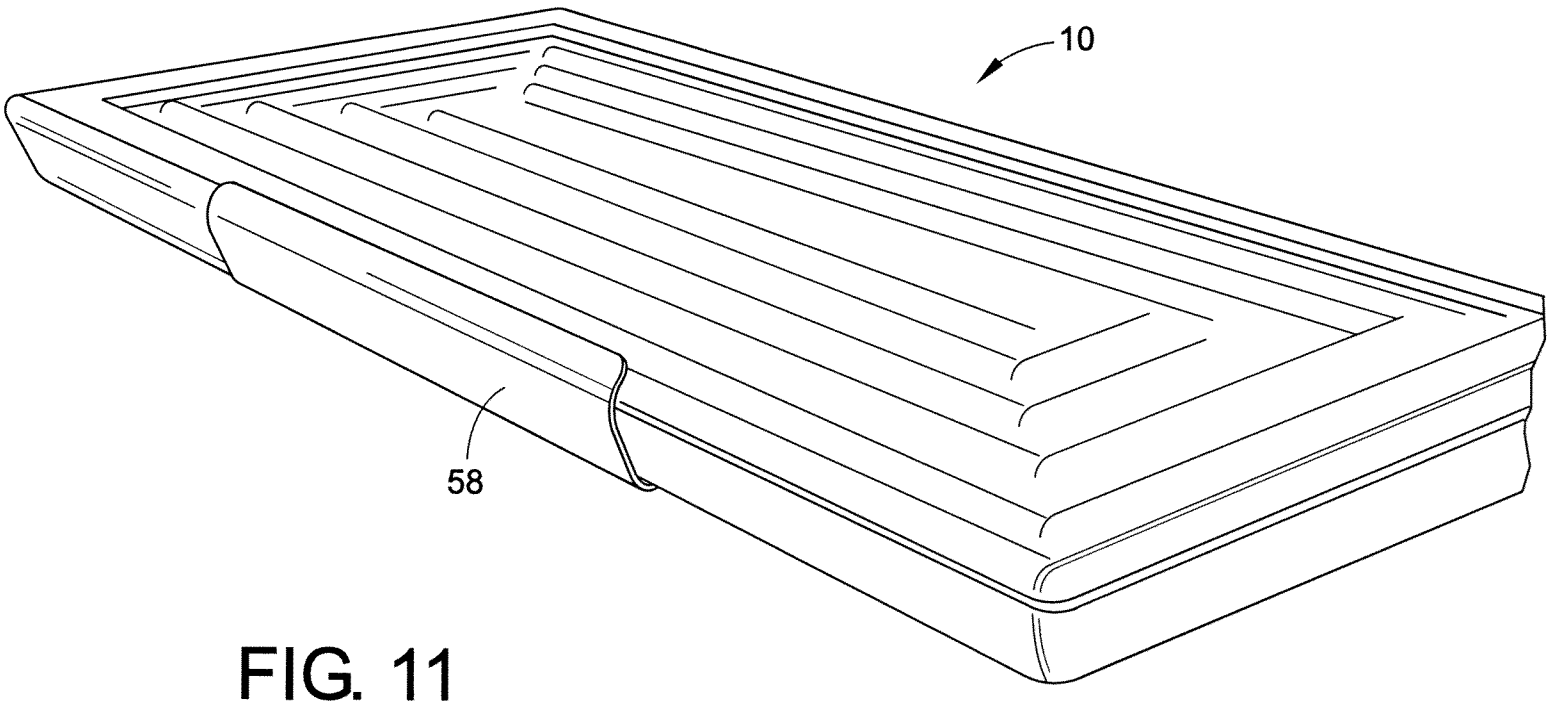
FIG. 11 illustrates an overhead side perspective view of an inflatable insulator according to a further embodiment.
Figure 12:
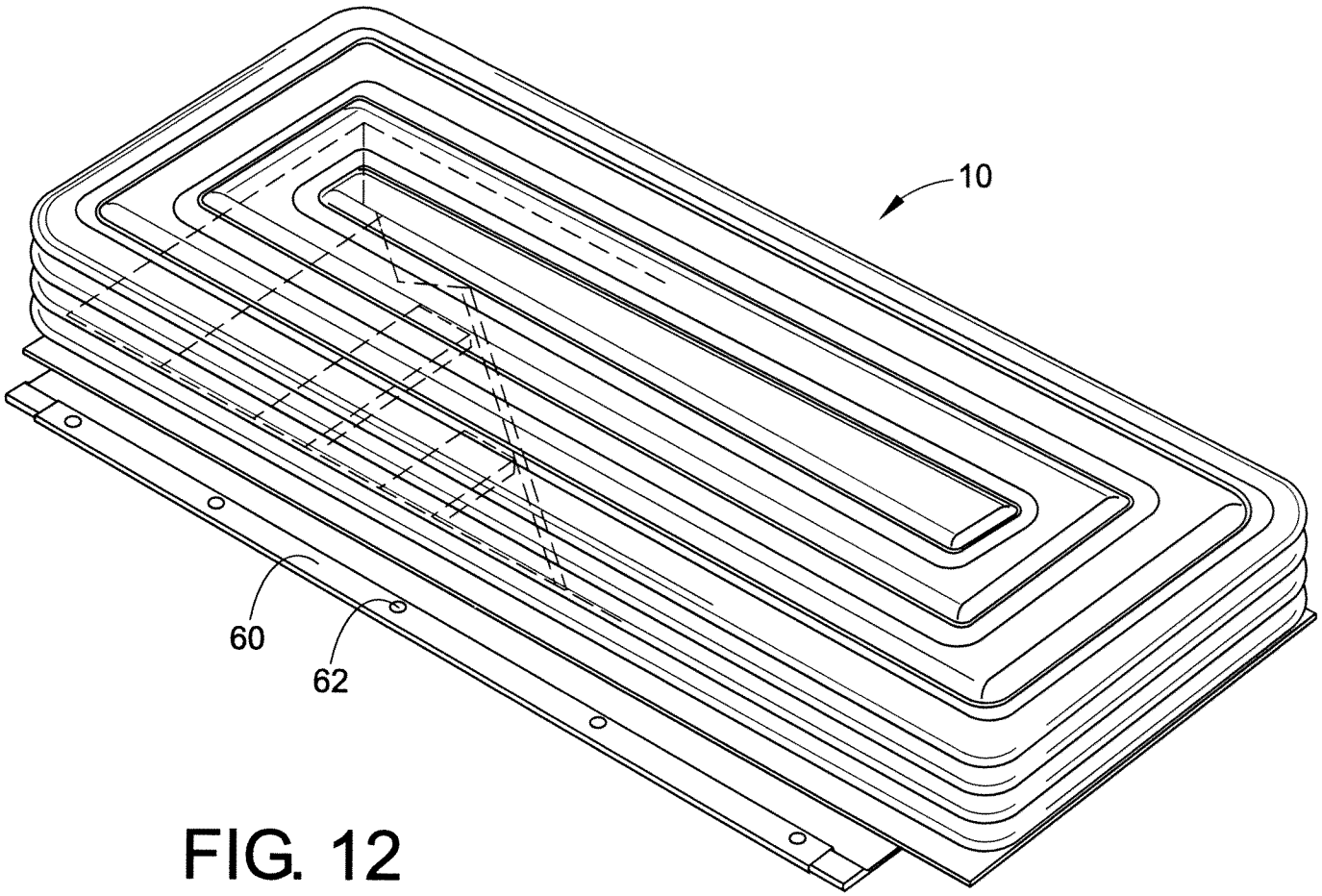
FIG. 12 illustrates an overhead perspective view of the insulator including a fastened rigid base.

In one embodiment, a slight urging force (or push upwardly) from the underside causes the insulator 10 to pivot outwardly away from the access hatch 200. FIG. 10 illustrates the insulator 10 pivoted away from the access hatch 200 to provide a passage to the attic space. It is anticipated that the insulator may include a hinge 56 (or similar pivot member) extending along at least an extent portion of the perimeter 24. In the illustrated embodiments, the hinge 56 extends along a longitudinal extent portion of the perimeter 24. In one embodiment, illustrated in FIG. 11, the hinge 56 is situated along one side of the perimeter as generally rectangular flexible member 58. The flexible member 58 is fixed to the attic floor by adhesive or fasteners (FIG. 12). The insulator 10 may be pivoted about the flexible member 58 between a closed position and an open position. Accordingly, the first wall 12 stands generally upright in a vertical plane, or beyond, when the insulator 10 is propped open.

In one embodiment, the hinge 56 may be affixed to a rigid base 60. FIG. 12 illustrates an embodiment of the rigid base 60. The rigid base 60 may be situated along at least an extent portion of the perimeter 24. In the illustrated embodiments, the rigid base 60 extends along a longitudinal extent portion of the perimeter 24 corresponding to the hinge 56. The rigid base 60 provides a member about which the insulator 10 may pivot in relation to the support structure.

In one embodiment, the rigid base 60 is a weighted body that is heavy enough to reduce a risk of the insulator body 10 from shifting. In another embodiment, the rigid base 60 is fastened or adhered to the support structure. FIG. 12 illustrates the rigid base 60 fastened to the support structure by means of at least one fastening member 62. A removable or a permanent adhesive is also contemplated for adhering the rigid base 60 to the support structure. Any mechanical or chemical attachment means is contemplated for attaching the rigid base 60 to the support structure without departing from embodiments of the disclosure. The hinge 56 may also include straps connected from the insulator 10 to the surrounding floor or opening 210 by adhesive, hook-and-loop fasteners or otherwise. The hinge 56 is optional.

Figure 9:
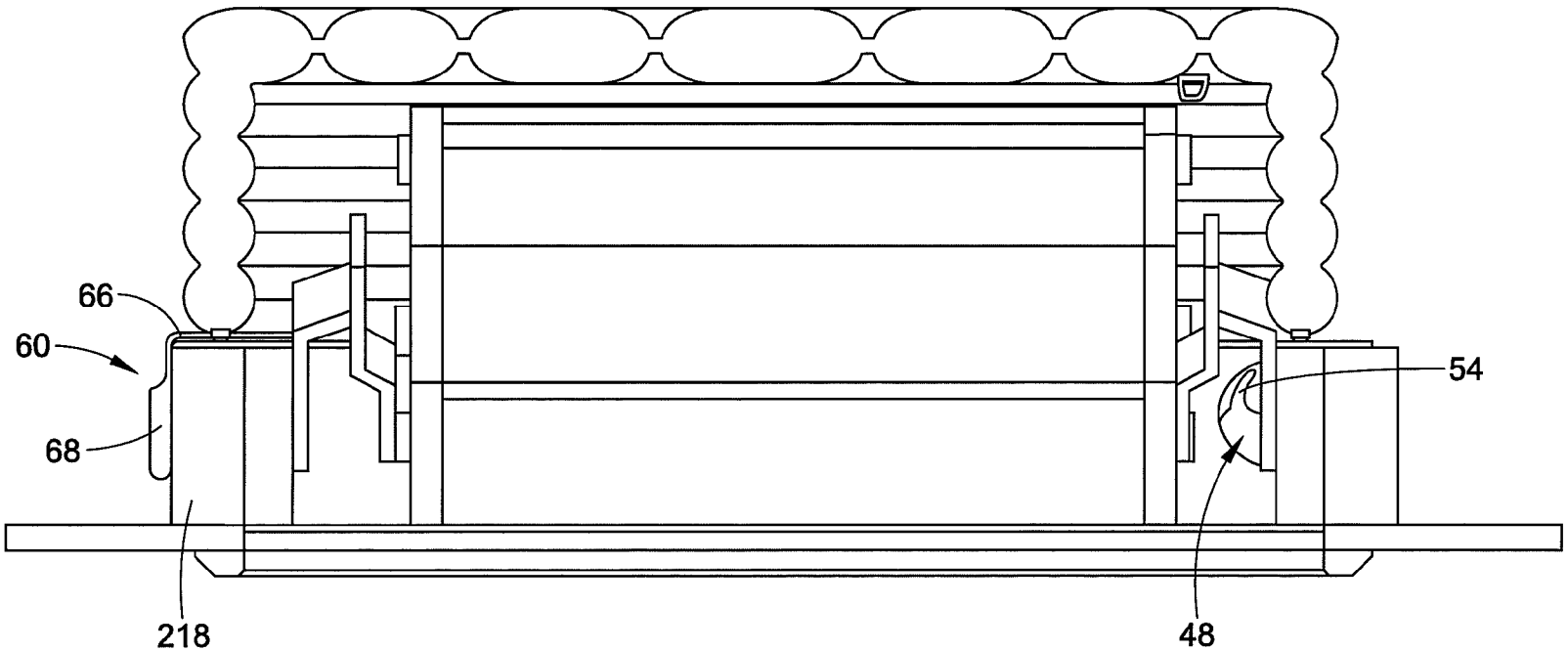
FIG. 9 illustrates a side cut-out view of the insulator taken along lines A-A of FIG. 3 and showing installation on a different attic floor construction.

As previously stated, the support structure may include the floor surface 214 or any fixed portion of the access hatch 200. FIGS. 5 and 9 illustrate a generally planar rigid base 60 adapted for attachment to the floor surface 214. The rigid base 60 extends outwardly from the perimeter 24 and is generally perpendicular to the perimeter 24 when the insulator 10 is in the operative (closed) position. The rigid base 60 includes a generally planar member 64 that is adapted to be fastened to a surface generally parallel to the first wall 12 when the insulator 10 is in the operative position. The rigid base may be an integral part of the hinge 56.

FIG. 9 illustrates another embodiment of the rigid base 60 adapted for attachment to the access hatch 200 and, more specifically, to the frame 212. The rigid base 60 is adapted for attachment to an outer oriented surface wall 218 forming the frame 212. The rigid base 60 extends outwardly from the perimeter 24. The hinge 56 may include a generally planar first leg 66 that is generally perpendicular to the perimeter 24 when the insulator 10 is in the operative position. Attached to a distal end of the first leg 66 is a generally planar second leg 68 forming the rigid base 60. The second leg 68 is adapted to be fastened to the surface 218 of the frame 214 that is generally perpendicular to the first wall 12 when the insulator 10 is in the operative position.

In the present disclosure, it is anticipated that the insulator 10 is in the deflated state at a point of sale and storage. One aspect of a sale of insulators 10 in the deflated state is a reduced package site and weight when compared to a non-inflatable product performing a similar function. This results in reduced transportation and/or shipment costs from the manufacturer to the distributor and/or from the distributor to the purchaser. Another aspect of inflatable insulators 10 provided in a deflated state is that they require less space consumption on the shelves or in contained storage units. Another aspect of the insulator 10 sold in a deflated state is easier passage of the insulator through the attic access hatch 200 at a time of assembly.

As previously stated, the insulator 10 may be provided in a kit. The kit may include the insulator 10 in a deflated state (i.e., rolled, folded, flattened, etc.) and an automatic inflation device. Another kit embodiment may include a deflated insulator, the strip(s) for the foam base, and the components of the connection means in a disassembled state. There is no limitation made herein to the components that may be included in packaging with the insulator.

Figure 14:
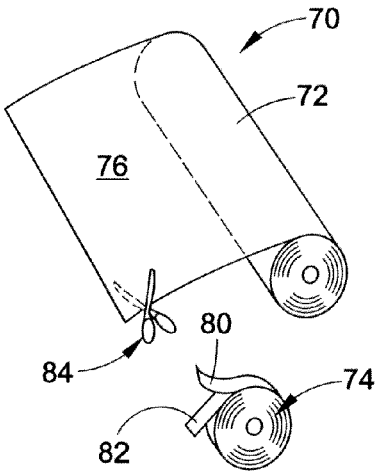
FIG. 14 illustrates a perspective view of another embodiment of an attic insulator including a roll of film and a roll of double-faced adhesive tape provided in a kit.

Another embodiment of an attic insulator 70 is shown in FIG. 14 and can also be provided in a kit form. FIG. 14 illustrates a sheet material that is adapted to adhere to the ceiling 204 proximate the recess 208 that defines the attic access hatch. In another embodiment, the attic insulator 70 can adhere to the face of the in step (i.e., recess 208) defined by the frame 212. FIG. 14 illustrates the kit as including a film 72 and tape 74. The film is illustrated as being provided in roll form, but other embodiments are contemplated as including the film in folds and flat sheets, etc. In one embodiment, the film 72 does not include a shrink material or stretch material, but rather includes a solid, impermeable material that holds in place and seals off cracks. In one embodiment, the film is thicker than shrink and stretch films.

The film 72 includes a matt surface 76 which may rest flush with the ceiling 204 when the attic insulator 70 is in operational position. In a preferred embodiment, the matt surface is opaque and generally blends with the ceiling, thus making it generally inconspicuous when observed from the living space. There is no limitation made herein to a color or a pattern provided on the matt surface 76, such as, for example, a stucco feature formed thereon the visible surface for imitating the ceiling 204. The opposite surface 78 of the film 72 includes a conventional material that easily bonds with a corresponding adhesive. Generally, this material is flat and not textured. The kit may optionally include a pair of scissors 84 or a similarly functioning razor adapted for modifying dimensions of the film or parting a select sheet of the film from the roll.

The attic insulator 70 further includes a strip(s) 80 of double-faced adhesive tape that is adapted to be applied over the full length of the attic frame 212. The roll of double-sided adhesive 74 includes the strip 80 that is adapted to be removed from a parting strip 82. In operation, at least one strip 80 of the double-faced adhesive tape 74 is adapted to be removed from the parted strip 82 and applied across the ceiling 204 proximate the attic access hatch or frame 212 defining the attic access hatch. More specifically, the strip 80 is adapted to be applied around a boundary defining the four sides of the recess 208. However, an order of operations is not limiting. Therefore, embodiments are contemplated wherein a strip 80 is adapted to be applied to a first side defining the boundary of the recess 208, and then the film may be trimmed using the scissors 84 before the strip 80 is applied to the remaining three sides.

A first surface of the strip 82 adheres to the ceiling 204 or frame 212. The adhesive formed on the first surface of the strip 82 is a low-tack adherent that is easily removable from the living space ceiling when the attic insulator 70 is removed. The adhesive formed on the second surface of the strip 82 may include the same or a different adherent. In one embodiment, the opposite adhesive surface of the strip remains exposed until the film is applied to it. However, one embodiment is contemplated as including a second parting strip also in contact with the opposite surface. In this manner, the optional second parting strip can be removed from the strip 80 after the strip 80 is attached to the ceiling and immediately before the film 72 is applied to the strip 80.

Figure 15:
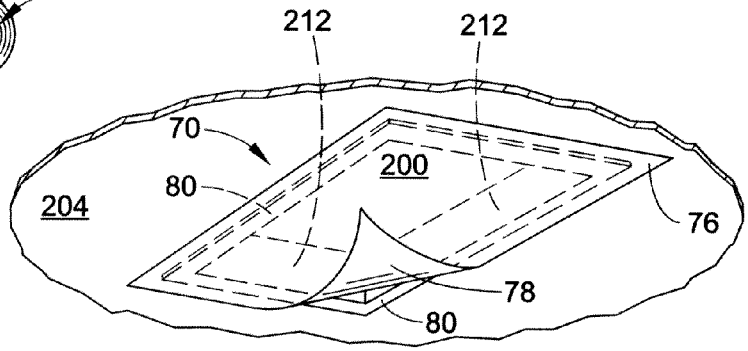
FIG. 15 illustrates a perspective view of the attic insulator embodiment of FIG. 14 observed from the living or work space.

FIG. 15 illustrates the attic insulator being applied to the attic access hatch. The rolled up film is adapted to be applied across the frame, wherein a leading edge of the film is applied just beyond the strip of the double-faced adhesive. The film may be optionally trimmed to select dimension, and this step can be performed before applying the film to the ceiling or after the roll of film is positioned in contact with the first strip adhering to the ceiling. The film is pressed against the exposed adhesive on the second surface of the strip 82 to seal the access to the attic.

In one embodiment, sticker static foam tapes are contemplated. In another embodiment, the adhesive formed on the strip of the double-sided adhesive tape is adapted to be removeable from the ceiling when the film is selectively removed or discarded for providing access to attic. The insulator 70 is therefore adapted for providing a removeable, remote protective sheet for preventing a flow of air from the house to the attic.

Figure 16:
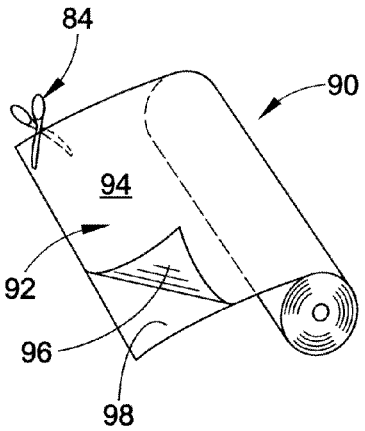
FIG. 16 illustrates a perspective view of a further embodiment of an attic insulator including a roll of film including an adhesive surface; and, FIG. 17 illustrates a perspective view of the attic insulator embodiment of FIG. 16 observed from the living or work space.

FIG. 16 illustrates another embodiment of an attic insulator 90. The attic insulator 90 of the discussed embodiment may be provided as a sheet of film 92 that is rolled or folded before being placed over the attic access hatch. The film 92 is a low-tack self-adherent film that is adapted to cover the attic access hatch from the living space side. In one embodiment, the film 92 may include a high quality vinyl 94 and low tack adhesive 96 similar to the adhesive plastic film skins that form conventional Fatheads®. In another embodiment, the insulator 90 includes a pressure sensitive adhesive backed film that uses pressure to urge the insulator 90 in contact with the ceiling 204. The first surface of the film 94 may include matte, transparent appearance that is observable from the living space, wherein the opposite, second surface of the film 96 includes a self-adhering characteristic that holds the attic insulator 90 against the surface of the framing. The second surface 96 of the film 92 forming the attic insulator 90 includes a highly removeable adhesive. In this manner, the film is self-adherent, removeable, and replacable.

The attic insulator 90 is adapted to be peeled from a parting layer 98, pressed into contact with a ceiling 204 or frame 212 surface, and smoothed out. In operation, the film 92 is removed from the parting layer 98 and applied to a smooth surface in the temperature controlled living space. As mentioned, this surface may include the ceiling 204 or the frame 212 defining the attic access hatch. The film 92 is formed of a material that is adapted to be easily trimmed. Accordingly, a kit embodiment is contemplated as including scissors 84 or a razor similarly functioning to adjust the size of the film 92 sheet.

Figure 17:
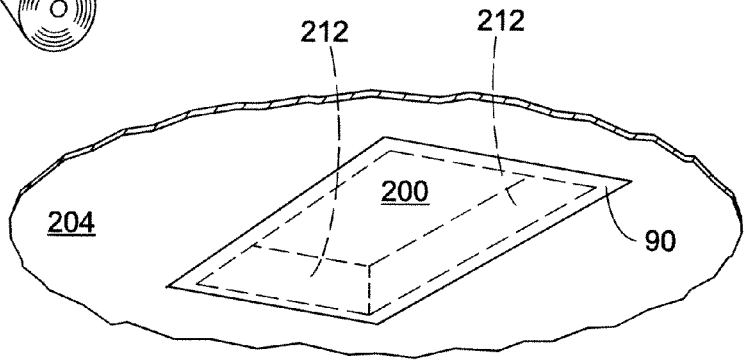

The film 92 is pressed against the frame 212, as illustrated in FIG. 17, to seal the cracks formed where the panel door meets the frame 212. In this manner, the attic insulator 90 takes advantage of the air flow gradient to enhance the sealing effect. Because warm air flows in the (upward) direction toward the attic, the attic insulator 90 uses air pressure for providing a suction effect. In the operational position, a portion of the second (self-adhering) surface 96 of the film 92 is not adhering to a contact surface at the recess 208. This portion of the film 92 may sag, but it is contemplated that the negative pressure gradient formed by the warm air moving upward will hold the film close to a plane sharing the contact (e.g. ceiling) surface.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An insulator for insulating an attic access hatch, comprising:

an inflatable body including:

a first flexible layer spaced apart from a second flexible layer and forming a chamber situated between the first and second flexible layers for containing a volume of stationary air, the first and second flexible layers situated between third and fourth protective layers covering at least a portion of outer oriented surfaces of the first and second flexible layers, a rigidity of the third and fourth layers protecting the first and second flexible layers from a puncture;

a polygonal and planar first wall defined by the first and second layers and being larger than an associated access hatch;

sidewalls defined by the first and second layers and extending downwardly from edges of the first wall, the sidewalls contacting an associated floor surface beyond a perimeter of the associated access hatch and removing the first wall from a direct contact with a frame defining the associated access hatch;

a connector operative for pulling the insulator toward the associated floor surface and being connected to one of the third and fourth layers;

wherein the chamber insulates the associated access hatch from transferring heat between a non-temperature controlled space and a temperature controlled space.

2. The insulator of claim 1, further including a seal extending along a perimeter of the inflatable body.

3. The insulator of claim 1, further including a valve situated on the inflatable body for selectively inflating the volume of stationary air into the chamber.

4. The insulator of claim 1, further including a hinge affixed to a perimeter portion of the inflatable body.

5. The insulator body of claim 4, further including a rigid base for attachment to a support surface, the inflatable body is adapted to pivot at the hinge toward and away from the rigid base.

6. The insulator of claim 1, further including a plurality of sub-chambers defining the first wall and each sidewall.

7. The insulator of claim 1, wherein said connector comprising:

at least a first connector affixed to an inner oriented surface of one of the third or fourth protective layers of the sidewall or the first wall;

at least a second connector affixed to an associated support surface in proximity to the associated access hatch; and, a flexible member selectively stretched to connect the at least first connector with the at least second connector.

8. The insulator of claim 1, further including a foam base for attachment to an associated support surface, the foam base being attached to the associated support surface where a perimeter of the sidewalls contact the associated support surface.

9. An insulator for preventing a transfer of heat from a first indoor environment maintaining temperature control and a second indoor environment not maintaining temperature control, the insulator comprising:

a polygonal and planar top wall;

sidewalls extending downwardly from edges of the top wall and contacting an associated floor surface beyond a perimeter of an associated opening of an associated access hatch, the sidewalls removing the top wall from a direct contact with the associated opening;

each of the top wall and sidewalls being fabricated from a first flexible impermeable layer spaced apart from a second flexible impermeable layer and at least one protective material layer covering at least a portion of an outer oriented surface of at least one of the first and second flexible layers of the planar top wall, a rigidity of the at least one protective material layer protecting the one of the first and second flexible layers from a puncture;

a valve formed through the first flexible layer and being adapted to receive an air flow for selectively inflating the insulator; and, a chamber between the first and the second flexible layers adapted to contain a volume of stationary air;

wherein the first flexible layer completely surrounds the associated opening for providing an access to the second indoor environment to prevent any movement of air from traveling beyond the associated opening and into the second indoor environment;

wherein the top wall and the sidewalls define a cavity above an access to the second environment.

10. The insulator of claim 9, wherein the first flexible impermeable layer is connected to the second flexible impermeable layer at a seal extending along a perimeter of the insulator.

11. The insulator of claim 9, further including a valve situated on the second flexible impermeable layer for placing the volume of stationary air into the chamber.

12. The insulator of claim 9, wherein the insulator is pivotally attached to an associated support surface.

13. The insulator of claim 12, further including:

a rigid base attached to the associated support structure; and, a hinge for pivotally attaching the insulator to the rigid base.

14. The insulator of claim 9, further including at least two sub-chambers.

15. The insulator of claim 9, further including a connection means for urging the insulator tightly against an associated support surface.

16. The insulator of claim 15, wherein the connection means includes:

at least a first connector affixed to an inner oriented surface of one of the sidewalls or the top wall;

at least a second connector affixed to an associated support surface in proximity to the associated access hatch; and, an elastic member selectively stretched to connect the at least first connector with the at least second connector.

17. The insulator body of claim 9, further including a foam base for attachment to an associated support surface, the foam base being attached to the associated support surface where a perimeter of the sidewalls contact the associated support surface.

18. An inflatable insulator for covering an associated attic access hatch, comprising:

at least one selectively inflatable air chamber adapted to contain a volume of stationary air, the inflatable air chamber contacting an associated floor surface beyond a perimeter of frame defining an opening of the associated attic access hatch;

at least two flexible impermeable layers defining the air chamber;

at least a third rigid layer for protecting an innermost one of the first and second layers from puncture; and, a connection means at least partially supported by the rigid layer and being adapted to provide a tension between the inflatable insulator and the associated floor surface;

wherein the at least two impermeable layers are supported above and removed from direct contact with the associated attic access hatch.

* * * * *